US012781754B2

(12) United States Patent
Wood

(10) Patent No.: US 12,781,754 B2
(45) Date of Patent: Nov. 3, 2026

(54) METHOD AND APPARATUS FOR CONTROLLING A CONDENSER FAN MOTOR

(71) Applicant: International Controls and Measurements Corporation, North Syracuse, NY (US)

(72) Inventor: Eric Christopher Wood, East Syracuse, NY (US)

(73) Assignee: International Controls and Measurements Corporation, North Syracuse, NY (US)

( * ) Notice: Subject to any disclaimer, the term of this patent is extended or adjusted under 35 U.S.C. 154(b) by 0 days.

(21) Appl. No.: 18/936,964

(22) Filed: Nov. 4, 2024

(65) Prior Publication Data

US 2025/0146502 A1 May 8, 2025

Related U.S. Application Data

(60) Provisional application No. 63/596,811, filed on Nov. 7, 2023.

(51) Int. Cl.
*F04D 27/00* (2006.01)
*F24F 11/81* (2018.01)

(52) U.S. Cl.
CPC ..... *F04D 27/004* (2013.01); *F24F 11/81* (2018.01)

(58) Field of Classification Search
CPC ..... F04D 27/004; F24F 11/81
See application file for complete search history.

(56) References Cited

U.S. PATENT DOCUMENTS 4,361,069 A * 11/1982 Peterson ..... G10B 3/16 84/346
2005/0163615 A1* 7/2005 Chheda ..... F04D 19/007 257/E23.099
2012/0086382 A1* 4/2012 Peto ..... H02M 1/4225 318/729
2023/0032000 A1* 2/2023 Yang ..... F24F 8/22

* cited by examiner

*Primary Examiner* — Shafiq Mian
(74) *Attorney, Agent, or Firm* — Brown & Brown IP Law PLLC

(57) ABSTRACT

Systems for controlling supplying power to a variable-speed fan motor, each system comprising at least a first sensor, and a controller, the sensor senses at least one characteristic from which voltage can be monitored, the controller is configured to:

Figure 1:
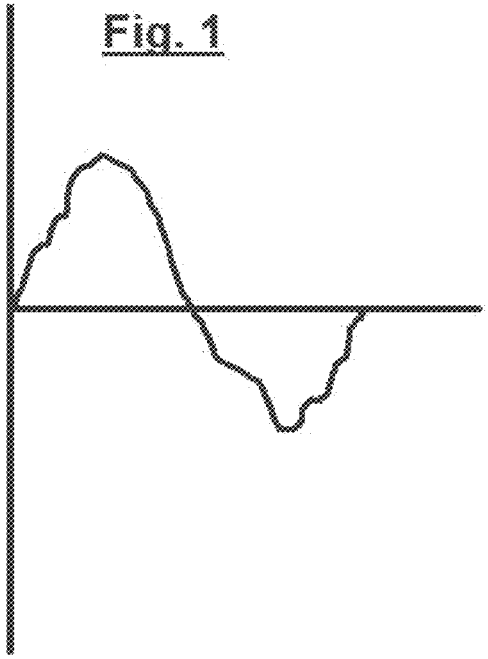

detect a magnitude of imbalance between positive voltage and negative voltage during cycles during operation of a fan motor, compare the detected magnitude of imbalance to a pre-selected threshold value, and if the detected magnitude of imbalance exceeds the pre-selected threshold value, automatically alter one or more characteristics of supplying power to the fan motor.

Also, methods for controlling supplying power to a variable-speed fan motor. Also, fan systems that comprise a sensor, a controller, a variable-speed motor and a fan.

27 Claims, 6 Drawing Sheets

METHOD AND APPARATUS FOR CONTROLLING A CONDENSER FAN MOTOR

CROSS-REFERENCE TO RELATED APPLICATIONS

This application claims the benefit under 35 U.S.C. 119 section (e) of U.S. Provisional Patent Application No. 63/596,811, filed Nov. 7, 2023, the entirety of which is incorporated herein by reference.

FIELD OF THE INVENTION

The present invention is directed to control systems, such as head pressure control systems, condenser fan systems, components thereof, and methods of controlling condenser fan systems and components of condenser fan systems.

BACKGROUND

Condensers are a component in air conditioning systems and other types of systems. The performance of a condenser can be optimized or controlled by adjusting power supplied to the motor that drives the fan of the condenser. There is an ongoing need for improvements in the functioning of condensers and their components, and components that interface or otherwise affect condensers, particularly with regard to efforts to reduce energy consumption, and/or to enhance the functional lifetimes of components.

BRIEF SUMMARY OF THE INVENTION

This section (i.e., "Brief Summary of the Invention") presents a simplified summary of the present invention in order to provide a basic understanding of some aspects of the invention. Included in this section are some concepts of the invention as a prelude to more detailed descriptions of aspects of the present invention, and representative embodiments in accordance with aspects of the present invention.

In some aspects, the present invention relates to condensers (e.g., for use in air conditioning systems) that include variable-speed fans (i.e., fans driven by variable speed motors). In such systems, by adjusting the speed of the fan (or fans), pressure ("head pressure") within the coils of a condenser can be controlled. In some instances, pressure within the coils can be controlled elegantly, avoiding or ameliorating many potential problems, e.g., liquid slugging (liquid entering the compressor). Head pressure can be detected directly by measuring pressure, and/or indirectly by measuring temperature. In some aspects, the speed of the fan (in response to the power supplied to the fan, e.g., in response to the applied voltage, current and/or duty cycle) is controlled in response to head pressure.

There are a large variety of variable-speed motors, e.g., three-phase and four-phase motors (AC motors, PSC motors (permanent split capacitor motors), ECM motors (electrically commutated motors), etc.) used to drive fans in various condenser systems upon being supplied with voltage, in which the speed of the motor (and thus the fan) can be altered by varying the voltage, current and/or duty cycle of electricity supplied to the variable-speed motors. The differing construction of the different types of variable-speed motors (and even differing construction of similar types of variable-speed motors) yields differing results for variable speed fan motor drivers, i.e., two different variable-speed motors (e.g., two different types of variable-speed motors or two of the same type of variable-speed motor) can provide different results (e.g., fan speed, smoothness, heating of the motor, etc.) upon being supplied the same sequence of voltage variations. In many instances, for example, the same AC waveform applied to different motors can result in some of the motors functioning well, while others of the motors function less than optimally, e.g., exhibiting unwanted effects, such as reduced work, heat generation that is greater than optimal, and/or damage to the motor.

The present invention provides for reduction in such unwanted effects. The present invention comprises, in some aspects, methods comprising detecting a magnitude of any imbalance between positive voltage and negative voltage during cycles (referred to herein as "the magnitude of imbalance," which can have a positive value (absolute value of the difference) or a zero value (no imbalance or negligible imbalance) during operation of a fan motor, and comparing the detected magnitude of imbalance to a pre-selected threshold value, and—if the detected magnitude of imbalance exceeds the pre-selected threshold value—automatically altering one or more characteristics of supplying power to the variable-speed fan motor, and control systems configured to perform such detecting, comparing and automatic altering. The present invention also provides components, and/or combinations of components, configured to carry out such detecting, comparing and automatic altering. In some aspects in accordance with the present invention, if the detected magnitude of imbalance exceeds the pre-selected threshold value, one or more characteristics of supplying power to the variable-speed condenser fan is automatically altered, after which the magnitude of imbalance is again detected, and if the detected magnitude of imbalance is again greater than the pre-selected threshold value, one or more characteristics of supplying power to the variable-speed condenser fan is again automatically altered, after which the magnitude of imbalance is again detected and compared to the pre-selected threshold value, and the altering of the one or more characteristics of supplying power and checking of the magnitude of imbalance are repeated until the detected magnitude of imbalance reaches a value that is below the pre-selected threshold value (and if the detected magnitude of imbalance is below the pre-selected threshold voltage value, the detecting of the magnitude of imbalance can be discontinued or it can optionally be continued, but the one or more characteristics of supplying power are not further altered until and unless the detected magnitude of imbalance again exceeds the pre-selected threshold value)

The magnitude of imbalance between positive voltage and negative voltage in accordance with the present invention is calculated by monitoring the voltage being supplied to the variable-speed motor, and is equal to the difference between (1) the area (per cycle) above zero volts in the waveform, and (2) the area (per cycle) below zero volts in the waveform. The magnitude of imbalance (and the pre-selected threshold value) can be expressed in terms of the difference between the area above zero volts per cycle and the area below zero volts per cycle (at a particular frequency, i.e., Hz), or in terms of a net average voltage, i.e., difference between the area (per cycle) above zero volts and the area (per cycle) below zero volts, divided by time (especially where frequency is being altered or is capable of being altered).

In some embodiments in accordance with the present invention, the characteristics of supplying power that can be altered include one or more characteristics selected from among:

altering the positive voltage start time of firing pulses;

altering the negative voltage start time of firing pulses;
altering the start times of both the positive voltage firing pulses and negative voltage firing pulses;
altering the positive voltage end time of firing pulses;
altering the negative voltage end time of firing pulses;
altering the end times of both the positive voltage firing pulses and the negative voltage firing pulses;
altering the duration of positive voltage firing pulses;
altering the duration of negative voltage firing pulses;
altering the durations of both the positive voltage firing pulses and the negative voltage firing pulses; and
altering the shape of the waveform in any other way.

In some aspects in accordance with the present invention, there is a closed feedback loop in which: (A) the magnitude of imbalance is detected, (B) then a comparison is made between the detected magnitude of imbalance and the pre-selected threshold value, (C) and then, if the detected magnitude of imbalance is less than or equal to the pre-selected threshold value, the loop returns to (A) after a duration of time; if the detected magnitude of imbalance is greater than the pre-selected threshold value, one or more characteristics of supplying power is/are altered, and the loop returns to (A) after a duration of time. In the comparisons between the detected magnitude of imbalance and the pre-selected threshold value, situations where the detected magnitude of imbalance and the pre-selected threshold value are equal can prompt altering one or more characteristics of supplying power or prompt no altering, i.e., the threshold can be "a particular value or less", or "a particular value or greater"; to simplify the discussion herein, wherever the comparison is described in the present specification in terms of determining whether the detected magnitude of imbalance is either: (1) greater than or equal to the threshold value, or (2) less than the threshold value, the present invention also contemplates the comparison instead being determining whether the detected magnitude of imbalance is either: (1) greater than the threshold value, or (2) less than or equal to the threshold value.

The duration of time before returning to (A) after the detected magnitude of imbalance is less than the pre-selected threshold value can be shorter than, longer than, or of the same duration as, the duration of time before returning to (A) after the detected magnitude of imbalance is greater than or equal to the pre-selected threshold value.

In many embodiments in accordance with the present invention, the duration of time before returning to (A) after the magnitude of imbalance is less than the pre-selected threshold value is substantially longer than the duration of time before returning to (A) after the detected magnitude of imbalance is greater than or equal to the pre-selected threshold value. In such embodiments, the closed feedback loop is much quicker where proceeding through a sequence of alterations to one or more characteristics of supplying power (where the motor is deemed to be operating unsatisfactorily in accordance with the present invention), compared to where the detected magnitude of imbalance is less than the pre-selected threshold value (where the motor is deemed to be operating satisfactorily in accordance with the present invention).

In some embodiments in accordance with the present invention, there are provided head pressure control systems that comprise one or more processors, e.g., a microcontroller unit (MCU). In some of such embodiments, the processor (or processors) is configured to: record detected magnitude of imbalance values and alterations of one or more characteristics of supplying power: store prior sequences of detected magnitude of imbalance values and alterations of one or more characteristics of supplying power; compare a current sequence of detected magnitude of imbalance values and one or more characteristics of supplying power to prior sequences of detected magnitude of imbalance values and alteration of one or more characteristics of supplying power (such "alteration" can involve a sequence in which there is a single alteration (i.e., a single alteration resulted in the detected magnitude of imbalance being less than or equal to the threshold) or a sequence in which there are more than one alteration; and cause the controller to follow a sequence in which the next alteration of one or more characteristics of supplying power corresponds to an alteration that achieved a favorable magnitude of imbalance after a sequence of detected magnitude of imbalance values and alteration (i.e., a sequence involving a single alteration or a sequence involving more than one alteration) of one or more characteristics of supplying power that correlates to the current sequence of detected magnitude of imbalance values and alteration of one or more characteristics of supplying power.

In some aspects in accordance with the present invention, there are provided methods in which a sequence of alteration (s) of one or more characteristics of supplying power is followed until the detected magnitude of imbalance becomes lower than the pre-selected threshold value.

In some aspects in accordance with the present invention, there are provided head pressure control systems that are configured to perform a stored sequence (or one of a plurality of stored sequences) of alteration(s) of one or more characteristics of supplying power until the detected magnitude of imbalance becomes lower than the pre-selected threshold value.

In accordance with a first aspect of the present invention, there is provided a system for controlling supplying power to a variable-speed fan motor, the system comprising:

at least a first sensor, and
a controller,
the sensor senses at least one characteristic from which voltage can be monitored,
the controller is configured to:
detect a magnitude of imbalance between positive voltage and negative voltage during cycles during operation of a variable-speed fan motor,
compare the detected magnitude of imbalance to a pre-selected threshold value, and
if the detected magnitude of imbalance exceeds the pre-selected threshold value, automatically alter one or more characteristics of supplying power to the variable-speed fan motor.

In some embodiments in accordance with the first aspect of the present invention, the magnitude of imbalance is calculated by monitoring the voltage being supplied to the variable-speed fan motor, and is equal to the difference between (1) the area, per cycle, above zero volts in the waveform, and (2) the area, per cycle, below zero volts in the waveform.

In some embodiments in accordance with the first aspect of the present invention, the magnitude of imbalance is calculated by monitoring the voltage being supplied to the variable-speed fan motor, and is equal to the difference between (1) the area above zero volts in the waveform, and (2) the area below zero volts in the waveform, per unit time.

In some embodiments in accordance with the first aspect of the present invention:

the system further comprises a variable-speed motor, a fan and a condenser,
the controller controls power supplied to the variable-speed motor, the variable-speed fan motor causes the fan to rotate upon power being supplied to the variable-speed fan motor, the condenser comprises condenser coils, and the fan is positioned and oriented to blow air toward the condenser coils upon the fan rotating.

In some embodiments in accordance with the first aspect of the present invention, said detecting a magnitude of imbalance, comparing the detected magnitude of imbalance to a pre-selected threshold value, and automatically altering one or more characteristics of supplying power to the variable-speed fan motor if the detected magnitude of imbalance exceeds the pre-selected threshold value are part of a closed feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than or equal to the pre-selected threshold value, returning to (A) after a first duration of time, and if the detected magnitude of imbalance is greater than the pre-selected threshold value, altering one or more characteristics of supplying power to the variable-speed fan motor, and then returning to (A) after a second duration of time.

In some of such embodiments, the first duration of time is less than the second duration of time.

In some embodiments in accordance with the first aspect of the present invention, said detecting a magnitude of imbalance, comparing the detected magnitude of imbalance to a pre-selected threshold value, and automatically altering one or more characteristics of supplying power to the variable-speed fan motor if the detected magnitude of imbalance exceeds the pre-selected threshold value are part of a closed feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than the pre-selected threshold value, returning to (A) after a first duration of time, and if the detected magnitude of imbalance is greater than or equal to the pre-selected threshold value, altering one or more characteristics of supplying power to the variable-speed fan motor, and then returning to (A) after a second duration of time.

In some of such embodiments, the first duration of time is less than the second duration of time.

In some embodiments in accordance with the first aspect of the present invention:

the controller comprises a processor, and the processor is configured to perform said detecting, said comparing and said automatically altering one or more characteristics of supplying power to the fan motor if the detected magnitude of imbalance exceeds the pre-selected threshold value.

In some of such embodiments:

the processor is also configured to:

record detected magnitude of imbalance values and alterations of one or more characteristics of supplying power; and store prior sequences of detected magnitude of imbalance values and alterations of one or more characteristics of supplying power.

In some of those embodiments, the processor is also configured to:

compare a current sequence of detected magnitude of imbalance values and alteration of one or more characteristics of supplying power to prior sequences of detected magnitude of imbalance values and alteration of one or more characteristics of supplying power; and cause the controller to follow a sequence in which the next alteration of one or more characteristics of supplying power corresponds to a stored alteration that achieved a favorable magnitude of imbalance after a sequence of detected magnitude of imbalance values and alteration of one or more characteristics of supplying power that correlates to the current sequence of detected magnitude of imbalance values and alteration of one or more characteristics of supplying power.

In some embodiments in accordance with the first aspect of the present invention, said automatically altering one or more characteristics of supplying power to the variable-speed fan motor comprises altering at least one or more characteristics selected from among:

the positive voltage start time of firing pulses;

the negative voltage start time of firing pulses;

the start times of both the positive voltage firing pulses and negative voltage firing pulses;

the positive voltage end time of firing pulses;

the negative voltage end time of firing pulses;

the end times of both the positive voltage firing pulses and negative voltage firing pulses;

the duration of positive voltage firing pulses;

the duration of negative voltage firing pulses;

the durations of both the positive voltage firing pulses and the negative voltage firing pulses; and the shape of the waveform (in any other way).

In some embodiments in accordance with the first aspect of the present invention, the first sensor is selected from among voltage sensors, current sensors and power sensors.

In accordance with a second aspect of the present invention, there is provided a method for controlling supplying power to a variable-speed fan motor, the method comprising:

detecting a magnitude of imbalance between positive voltage and negative voltage during cycles during operation of a variable-speed fan motor, comparing the detected magnitude of imbalance to a pre-selected threshold value, and if the detected magnitude of imbalance exceeds the pre-selected threshold value, automatically altering one or more characteristics of supplying power to the variable-speed fan motor.

In some embodiments in accordance with the second aspect of the present invention, the magnitude of imbalance is calculated by monitoring the voltage being supplied to the variable-speed fan motor, and is equal to the difference between (1) the area, per cycle, above zero volts in the waveform, and (2) the area, per cycle, below zero volts in the waveform.

In some embodiments in accordance with the second aspect of the present invention, the magnitude of imbalance is calculated by monitoring the voltage being supplied to the variable-speed fan motor, and is equal to the difference between (1) the area above zero volts in the waveform, and (2) the area below zero volts in the waveform, per unit time.

In some embodiments in accordance with the second aspect of the present invention:

the variable-speed fan motor is part of a system that comprises the variable-speed fan motor, a fan and a condenser, the method further comprises controlling power supplied to the variable-speed fan motor, the variable-speed fan motor causes the fan to rotate upon power being supplied to the variable-speed fan motor, the condenser comprises condenser coils, and the fan is positioned and oriented to blow air toward the condenser coils upon the fan rotating.

In some embodiments in accordance with the second aspect of the present invention, said detecting a magnitude of imbalance, comparing the detected magnitude of imbalance to a pre-selected threshold value, and, if the detected magnitude of imbalance exceeds the pre-selected threshold value, automatically altering one or more characteristics of supplying power to the variable-speed fan motor, are part of a closed feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than or equal to the pre-selected threshold value, returning to (A) after a first duration of time, and if the detected magnitude of imbalance is greater than the pre-selected threshold value, altering one or more characteristics of supplying power to the variable-speed fan motor, and then returning to (A) after a second duration of time.

In some of such embodiments, the first duration of time is less than the second duration of time.

In some embodiments in accordance with the second aspect of the present invention, said detecting a magnitude of imbalance, comparing the detected magnitude of imbalance to a pre-selected threshold value, and automatically altering one or more characteristics of supplying power to the variable-speed fan motor if the detected magnitude of imbalance exceeds the pre-selected threshold value are part of a closed feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than the pre-selected threshold value, returning to (A) after a first duration of time, and if the detected magnitude of imbalance is greater than or equal to the pre-selected threshold value, altering one or more characteristics of supplying power to the variable-speed fan motor, and then returning to (A) after a second duration of time.

In some of such embodiments, the first duration of time is less than the second duration of time.

In some embodiments in accordance with the second aspect of the present invention:

the method further comprises:

recording detected magnitude of imbalance values and alterations of one or more characteristics of supplying power; and storing prior sequences of detected magnitude of imbalance values and alterations of one or more characteristics of supplying power.

In some of such embodiments, the method further comprises:

comparing a current sequence of detected magnitude of imbalance values and alteration of one or more characteristics of supplying power to prior sequences of detected magnitude of imbalance values and alteration of one or more characteristics of supplying power; and controlling supplying power to a variable-speed motor to follow a sequence in which the next alteration of one or more characteristics of supplying power corresponds to a stored alteration that achieved a favorable magnitude of imbalance after a sequence of detected magnitude of imbalance values and alteration of one or more characteristics of supplying power that correlates to the current sequence of detected magnitude of imbalance values and alteration of one or more characteristics of supplying power.

In some embodiments in accordance with the second aspect of the present invention, said automatically altering one or more characteristics of supplying power to the variable-speed fan motor comprises altering at least one or more characteristics selected from among:

the positive voltage start time of firing pulses;

the negative voltage start time of firing pulses;

the start times of both the positive voltage firing pulses and negative voltage firing pulses;

the positive voltage end time of firing pulses;

the negative voltage end time of firing pulses;

the end times of both the positive voltage firing pulses and negative voltage firing pulses;

the duration of positive voltage firing pulses;

the duration of negative voltage firing pulses;

the durations of both the positive voltage firing pulses and the negative voltage firing pulses; and the shape of the waveform (in any other way).

In accordance with a third aspect of the present invention, there is provided a fan system, comprising:

at least a first sensor;

a controller;

a variable-speed fan motor; and a fan, the sensor senses at least one characteristic from which voltage can be monitored, the controller is configured to:

detect a magnitude of imbalance between positive voltage and negative voltage during cycles during operation of the variable-speed fan motor, compare the detected magnitude of imbalance to a pre-selected threshold value, and if the detected magnitude of imbalance exceeds the pre-selected threshold value, automatically alter one or more characteristics of supplying power to the variable-speed fan motor, the variable-speed motor causes the fan to rotate upon power being supplied to the variable-speed motor.

In some embodiments in accordance with the third aspect of the present invention, the magnitude of imbalance is calculated by monitoring the voltage being supplied to the variable-speed fan motor, and is equal to the difference between (1) the area, per cycle, above zero volts in the waveform, and (2) the area, per cycle, below zero volts in the waveform.

In some embodiments in accordance with the third aspect of the present invention, the magnitude of imbalance is calculated by monitoring the voltage being supplied to the variable-speed fan motor, and is equal to the difference between (1) the area above zero volts in the waveform, and (2) the area below zero volts in the waveform, per unit time.

In some embodiments in accordance with the third aspect of the present invention, said detecting a magnitude of imbalance, comparing the detected magnitude of imbalance to a pre-selected threshold value, and automatically altering one or more characteristics of supplying power to the variable-speed fan motor if the detected magnitude of imbalance exceeds the pre-selected threshold value are part of a closed feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than or equal to the pre-selected threshold value, returning to (A) after a first duration of time, and if the detected magnitude of imbalance is greater than the pre-selected threshold value, altering one or more characteristics of supplying power to the variable-speed fan motor, and then returning to (A) after a second duration of time.

In some of such embodiments, the first duration of time is less than the second duration of time.

In some embodiments in accordance with the third aspect of the present invention, said detecting a magnitude of imbalance, comparing the detected magnitude of imbalance to a pre-selected threshold value, and automatically altering one or more characteristics of supplying power to the variable-speed fan motor if the detected magnitude of imbalance exceeds the pre-selected threshold value are part of a closed feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than the pre-selected threshold value, returning to (A) after a first duration of time, and if the detected magnitude of imbalance is greater than or equal to the pre-selected threshold value, altering one or more characteristics of supplying power to the variable-speed fan motor, and then returning to (A) after a second duration of time.

In some of such embodiments, the first duration of time is less than the second duration of time.

In some embodiments in accordance with the third aspect of the present invention:

the controller comprises a processor, and the processor is configured to perform said detecting, said comparing and said automatically altering one or more characteristics of supplying power to the variable-speed fan motor if the detected magnitude of imbalance exceeds the pre-selected threshold value.

In some of such embodiments:

the processor is also configured to:

record detected magnitude of imbalance values and alterations of one or more characteristics of supplying power; and store prior sequences of detected magnitude of imbalance values and alterations of one or more characteristics of supplying power.

In some of these embodiments, the processor is also configured to:

compare a current sequence of detected magnitude of imbalance values and alteration of one or more characteristics of supplying power to prior sequences of detected magnitude of imbalance values and alteration of one or more characteristics of supplying power; and cause the controller to follow a sequence in which the next alteration of one or more characteristics of supplying power corresponds to a stored alteration that achieved a favorable magnitude of imbalance after a sequence of detected magnitude of imbalance values and alteration of one or more characteristics of supplying power that correlates to the current sequence of detected magnitude of imbalance values and alteration of one or more characteristics of supplying power.

In some embodiments in accordance with the third aspect of the present invention, said automatically altering one or more characteristics of supplying power to the variable-speed fan motor comprises altering at least one or more characteristics selected from among:

the positive voltage start time of firing pulses;

the negative voltage start time of firing pulses;

the start times of both the positive voltage firing pulses and negative voltage firing pulses;

the positive voltage end time of firing pulses;

the negative voltage end time of firing pulses;

the end times of both the positive voltage firing pulses and negative voltage firing pulses;

the duration of positive voltage firing pulses;

the duration of negative voltage firing pulses;

the durations of both the positive voltage firing pulses and the negative voltage firing pulses; and the shape of the waveform (in any other way).

In some embodiments in accordance with the third aspect of the present invention, the first sensor is selected from among voltage sensors, current sensors and power sensors.

In some embodiments in accordance with the third aspect of the present invention:

the system further comprises a condenser, the condenser comprises condenser coils, and the fan is positioned and oriented to blow air toward the condenser coils upon the fan rotating.

The invention may be more fully understood with reference to the accompanying drawings and the following detailed description of the invention.

BRIEF DESCRIPTION OF THE DRAWING FIGURES

FIG. 1 is a plot of one cycle of a waveform for voltage supplied to a variable-speed motor, in which there is a significant imbalance between positive voltage and negative voltage during cycles during operation of a variable-speed motor for a fan used to provide cooling in a condenser.

Figure 2:
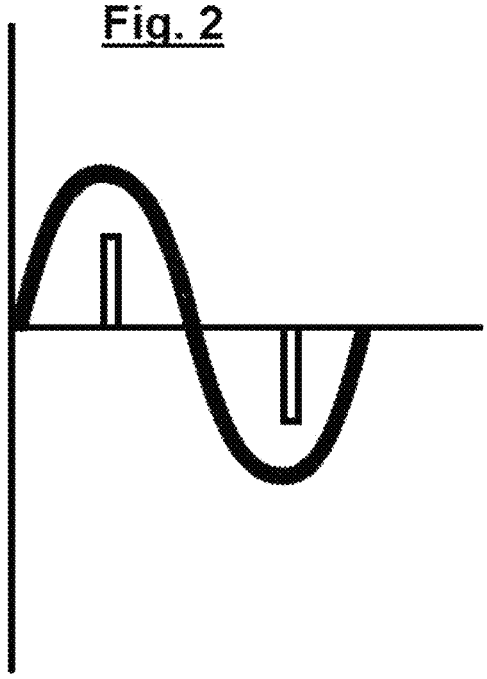

FIG. 2 schematically depicts a plot of voltage vs. time for an example in which triac gating signals are providing 50 percent output.

Figure 3:
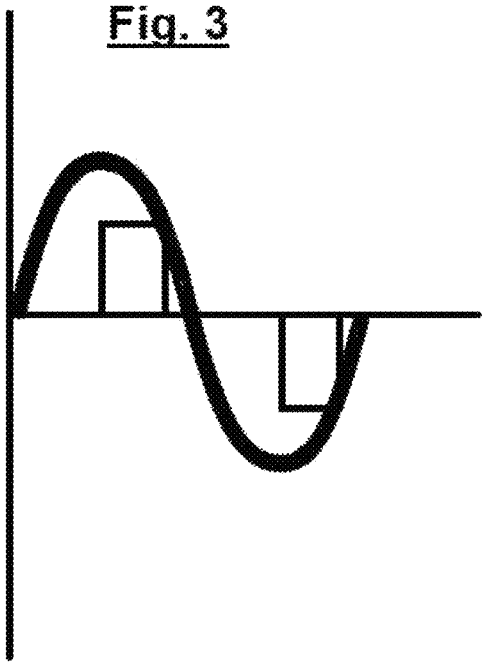

FIG. 3 schematically depicts an example that is similar to that of FIG. 2, except that the durations of the gate firing pulses are much longer than those depicted in FIG. 2.

Figure 4:
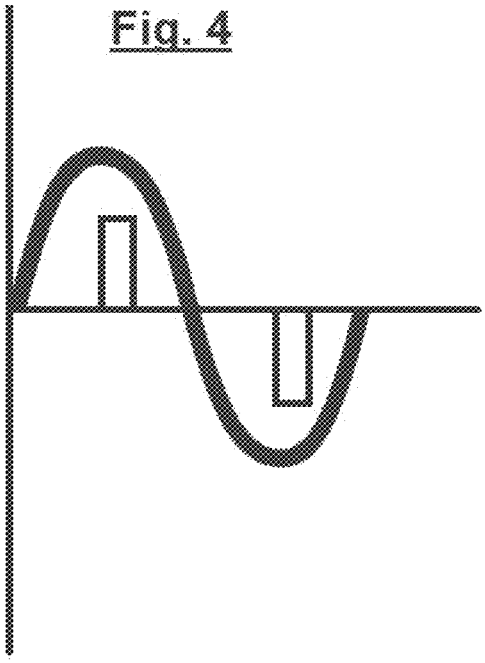

FIG. 4 schematically depicts an example that is similar to that of FIG. 2, except that the durations of the gate firing pulses are longer than those depicted in FIG. 2 and shorter than those depicted in FIG. 3.

Figure 5:
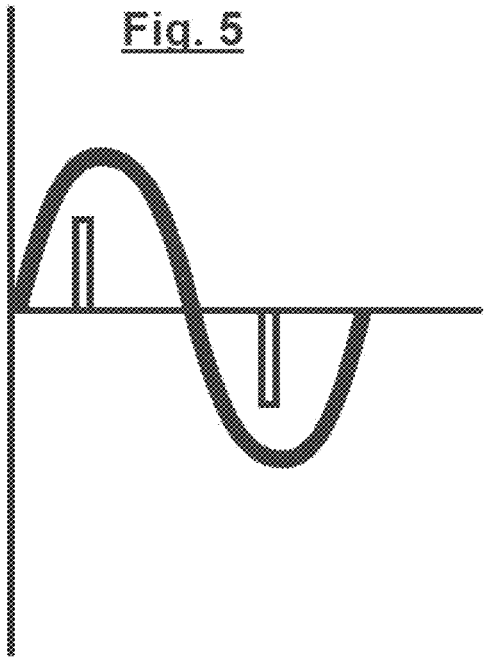

FIG. 5 schematically depicts an example that is similar to that of FIG. 2, except that the gating signals are providing 75 percent output.

Figure 6:
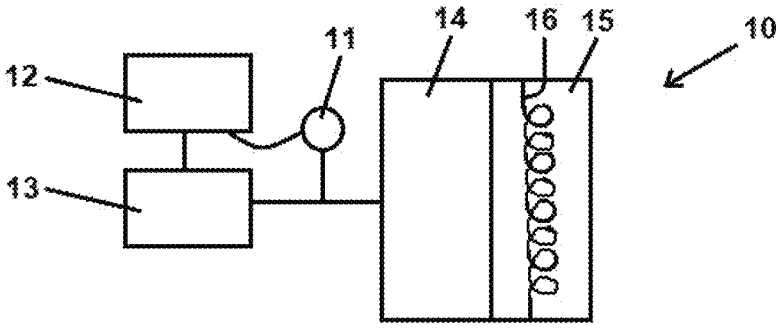

FIG. 6 schematically depicts a condenser fan system 10 that comprises a first sensor 11, a controller 12, a variable-speed fan motor 13, a variable-speed fan 14 and a condenser 15.

DETAILED DESCRIPTION OF THE INVENTION

The expression "invention" is used herein to refer to any portion (or portions) of the inventive subject matter disclosed herein. As described herein, the present invention includes many aspects.

The expression "comprises" or "comprising," is used herein in accordance with its well known usage, and means that the item that "comprises" the recited elements (or that is "comprising" the recited elements) includes at least the recited elements, and can optionally include any additional elements. For example, an item that "comprises at least a first sensor and a controller" includes at least one sensor and at least one controller, i.e., it can include a single sensor or a plurality of sensors (and likewise can include a single controller or a plurality of controllers), and may include no other items, or may further comprise any number of each of one or more items that is/are not recited.

Where an expression is defined herein in terms of the meaning of the expression in the singular, the definition applies also to the plural (and vice-versa, i.e., for an expression defined herein in the plural, the definition applies also to the singular). Definitions of one form of an expression apply to the same expression in a different form of the word or words.

As used herein, the singular forms "a", "an" and "the" are intended to include the plural forms as well, unless the context clearly indicates otherwise.

Although the terms "first", "second", etc. may be used herein to describe various things (e.g., durations of time), such things are not limited by these terms. These terms are only used to distinguish one thing from another.

The expression "embodiment," as used herein, means an embodiment in accordance with the present invention, i.e., an embodiment that is encompassed within the present inventive subject matter.

The expression "in some embodiments," as used herein, refers to features that can be included in some embodiments and not others, i.e., the feature(s) is/are optional. Where the expression "in some embodiments" is used, the embodiment can include the feature discussed, and can also include or not include any of other features described herein, including features that are similarly described as being provided "in some embodiments."

Any statement herein that an item (e.g., a controller or a processor) is configured to perform some action means that at least one component (or a combination of two or more components) in the item is configured to perform such action, e.g., a controller that is configured to detect a magnitude of imbalance between positive voltage and negative voltage during cycles during operation of a fan motor, comprises a component or a combination of two or more components that detect a magnitude of imbalance between positive voltage and negative voltage during cycles during operation of a fan motor.

Unless otherwise defined, all terms (including technical and scientific terms) used herein have the same meaning as commonly understood by one of ordinary skill in the art to which this invention belongs. Terms and expressions, such as those defined in commonly used dictionaries, should each be interpreted as having a meaning that is consistent with their meaning in the context of the relevant art and the present disclosure, and not in an idealized or overly formal sense (unless expressly so defined herein).

Detailed descriptions of embodiments that correspond to the present invention (and/or aspects of the present invention), and detailed descriptions of features that are provided in some embodiments in accordance with the present invention, are provided hereinafter, in many instances with reference to the accompanying drawings, in which representative embodiments in accordance with the present invention are shown. These detailed descriptions of specific aspects of the present invention, and embodiments in accordance with the present invention, are provided to describe features of the present invention with reference to a specific embodiment or embodiments. The present invention should not be construed as being limited to the specific features in the embodiments set forth herein.

As noted above, in accordance with a first aspect of the present invention, there is provided a system for controlling supplying power to a variable-speed fan motor, the system comprising at least a first sensor and a controller, in which the sensor senses at least one characteristic from which voltage can be monitored. Those of skill in the art are familiar with a variety of devices and components (and combinations of components) that sense one or more characteristics (e.g., voltage, current and/or power) from which voltage can be monitored, e.g., voltage sensors, current sensors and power sensors.

FIG. 1 is a plot of one cycle of a waveform for voltage supplied to a variable-speed motor, in which there is a significant imbalance between positive voltage and negative voltage during cycles during operation of a variable-speed motor for a fan used to provide cooling in a condenser. In the plot in FIG. 1, the area (per cycle, in this case, only a single cycle is shown) above zero volts in the waveform exceeds the area (per cycle) below zero volts in the waveform by an average of about 8 volts. If the magnitude of imbalance (8 volts) exceeds the pre-selected threshold value (e.g., an average of 1 volt), the controller automatically alters one or more characteristics of supplying power to the variable-speed fan motor.

In accordance with the present invention, during operation of a compressor, the voltage waveform (voltage vs. time) is monitored, and the difference between the area above zero volts in the waveform (per cycle) and the area below zero volts in the waveform (per cycle) is determined (and monitored) and compared to a pre-selected threshold value (the threshold value can be altered as desired), or the difference between the area above zero volts vs. the area below zero volts, divided by time elapsed, is determined and monitored, and compared to a pre-selected threshold value (which can likewise be altered as desired).

As noted above, said automatically altering one or more characteristics of supplying power to the fan motor comprises altering at least one or more characteristics selected from among:

- the positive voltage start time of firing pulses;
- the negative voltage start time of firing pulses;
- the start times of both the positive voltage firing pulses and negative voltage firing pulses;
- the positive voltage end time of firing pulses;

the negative voltage end time of firing pulses;

the end times of both the positive voltage firing pulses and negative voltage firing pulses;

the duration of positive voltage firing pulses;

the duration of negative voltage firing pulses;

the durations of both the positive voltage firing pulses and the negative voltage firing pulses; and the shape of the waveform (in any other way).

FIG. 2 schematically depicts a plot of voltage vs. time for an example in which triac gating signals are providing 50 percent output. The waveform (theoretical) is shown as a sine wave, and the gate firing pulses are shown as rectangles (vertically elongated), with the width (i.e., along the horizontal axis) of each gate firing pulse representing the duration of the respective firing pulse.

FIG. 3 schematically depicts an example that is similar to that of FIG. 2, except that the durations of the gate firing pulses are much longer than those depicted in FIG. 2.

FIG. 4 schematically depicts an example that is similar to that of FIG. 2, except that the durations of the gate firing pulses are longer than those depicted in FIG. 2 and shorter than those depicted in FIG. 3.

FIG. 5 schematically depicts an example that is similar to that of FIG. 2, except that the gating signals are providing 75 percent output.

In the schematic plots of each of FIGS. 2-5, the start times of the firing pulses for each of the positive voltage and the negative voltage are represented by the left edge of the firing pulse, the end times of the firing pulses for each of the positive voltage and the negative voltage are represented by the right edge of the firing pulse, and the durations of the firing pulses for each of the positive voltage and the negative voltage are represented by the length of time between the left edge of the firing pulse and the right edge of the firing pulse. In the schematic plots of each of FIGS. 2-5, the first and second quadrants of the cycle are during the time that the sine wave is above zero volts, with the first quadrant prior to the peak positive voltage and the second quadrant after the peak positive voltage, and the third and fourth quadrants of the cycle are during the time that the sine wave is below zero volts, with the third quadrant prior to the peak negative voltage and the fourth quadrant after the peak negative voltage.

FIGS. 2-5 each depict examples in which the start time of the firing pulse for the positive voltage (i.e., within the first and second quadrants of the waveform) is at a position (time relative to the prior zero cross (50) percent output in FIGS. 2-4, and 75 percent output in FIG. 5)) that is analogous to the position (time relative to the prior zero cross (also 50 percent output in FIGS. 2-4, and 75 percent output in FIG. 5)) of the start time of the firing pulse for the negative voltage (i.e., within the third and fourth quadrants of the waveform), and the duration of the firing pulse for the positive voltage is the same as the duration of the firing pulse for the negative voltage (and therefore the end time of the firing pulse for the positive voltage is also at a position that is analogous to the end time of the firing pulse for the negative voltage). As indicated elsewhere herein, it is not essential that the start times, end times and/or durations of the respective firing pulses be analogous, i.e., in many embodiments, the start time of the firing pulse for the positive voltage differs from the start time of the firing pulse for the negative voltage, the end time of the firing pulse for the positive voltage differs from the end time of the firing pulse for the negative voltage, and/or the duration of the firing pulse for the positive voltage differs from the duration of the firing pulse for the negative voltage. In some instances, for example, if the detected area, per cycle, above zero volts in the waveform is greater than the area, per cycle, below zero volts in the waveform, the controller can move back the start time of the firing pulse for the positive voltage and/or advance the start time of the firing pulse for the negative voltage.

Those of skill in the art are familiar with a wide variety of components (and combinations of components) that can be employed to provide desired energy output (e.g., percentage output (i.e., percentage of the waveform during which energy is supplied) and/or alter waveforms, and any of such components (and combinations of components) can be employed in systems (or controllers) in accordance with the present invention. For example, those of skill in the art are familiar with a wide variety of switches (e.g., relays), such as triacs, silicon-controlled rectifiers (SCRs) and insulated-gate bipolar transistors (IGBTs). In the case of triacs, as is well known, once voltage begins being supplied after a firing pulse, voltage continues to be supplied until the next zero crossing.

In some instances (e.g., depending on the particular variable-speed fan motor being employed), a duration of firing pulses might be insufficient (i.e., the motor does not turn on during the first and second quadrants and/or during the third and fourth quadrants) because the duration of the firing pulse is too short, and/or the end of the firing pulse might be too close to the next zero cross (i.e., the motor does not turn on during the first and second quadrants and/or during the third and fourth quadrants) because the end of the firing pulse is too close to the next zero cross. In accordance with another aspect of the present invention, in such instances, a controller in systems of the present invention automatically alters the start times of firing pulses, the end times of firing pulses, and/or the durations of the firing pulses to cause the motor to turn on properly. The durations of the firing pulses can be increased by advancing the start times of the firing pulses, moving back the end times of the firing pulses, or altering the start times of the firing pulses and the end times of the firing pulses such that the durations of the firing pulses are increased. The end times of the firing pulses can be advanced by moving up the end times of the firing pulses (and optionally also changing the start times of the firing pulses). In some embodiments of systems in accordance with this aspect, there is a closed feedback loop in which:

(A) the system detects whether the motor is turning on properly (i.e., sometime during the first or second quadrant of each cycle and sometime during the third or fourth quadrant of each cycle), then (B) if the motor is not turning on properly, the system automatically alters the start time, the end time and/or the duration of the positive voltage firing pulse and/or the negative voltage firing pulse, and then (C) the system again detects whether motor is turning on properly, and:

if the system detects that the motor is not turning on properly, the system returns to part (B) after a first duration of time, and if the system detects that the motor is turning on properly, the system returns to part (A) after a second duration of time (the second duration of time can be the same as or different from the first duration of time, and is usually longer than the first duration of time).

As noted above, in some embodiments in accordance with the present invention, the controller comprises a processor. In some of such embodiments, the processor is configured to perform the detecting, the comparing and the automatically altering one or more characteristics of supplying power to the variable-speed fan motor if the detected magnitude of imbalance exceeds the pre-selected threshold value (as described herein). In some of such embodiments, the processor is also configured to (or another processor is provided, which is configured to):

record detected magnitude of imbalance values and alterations of one or more characteristics of supplying power; and store prior sequences of detected magnitude of imbalance values and alterations of one or more characteristics of supplying power, and in some of such embodiments, the processor (or other processor) is also configured to:

compare a current sequence of detected magnitude of imbalance values and alteration of one or more characteristics of supplying power to prior sequences of detected magnitude of imbalance values and alteration (i.e., a single alteration or plural alterations) of one or more characteristics of supplying power; and cause the controller to follow a sequence in which the next alteration of one or more characteristics of supplying power corresponds to a stored alteration that achieved a favorable magnitude of imbalance after a sequence of detected magnitude of imbalance values and alteration of one or more characteristics of supplying power that correlates to the current sequence of detected magnitude of imbalance values and alteration of one or more characteristics of supplying power. A sequence of stored detected magnitude of imbalance values and alteration(s) of one or more characteristics of supplying power (a "stored sequence") can comprise any number of detected imbalance values and any number of alterations; each stored sequence includes at least one detected imbalance value, at least one alteration, and at least one subsequent detected imbalance value. In some of such embodiments, if an imbalance is detected (or a sequence of imbalances and one or more alterations occur), the imbalance (or the sequence of imbalances and one or more alterations) is compared to the sequences of stored imbalances and alterations, and the stored sequence of imbalance(s) and alteration(s) that most closely resembles the current imbalance (or sequence of imbalances and one or more alterations) is identified, and an alteration in the stored sequence that resulted in the imbalance becoming less than the pre-selected threshold value is made. In some embodiments, the actual waveform that is observed is compared to stored waveforms, the stored waveform that most closely resembles the current waveform is identified, and an alteration that resulted in changing the stored waveform that most closely resembles the current waveform such that the imbalance became less than the pre-selected threshold value is made.

FIG. 6 schematically depicts a condenser fan system 10 that comprises a first sensor 11, a controller 12, a variable-speed fan motor 13, a variable-speed fan 14 and a condenser 15.

The sensor 11 senses at least one characteristic from which voltage can be monitored.

The controller 12 is configured to:

detect a magnitude of imbalance between positive voltage and negative voltage during cycles during operation of the variable-speed fan motor 13, compare the detected magnitude of imbalance to a pre-selected threshold value, and if the detected magnitude of imbalance exceeds the pre-selected threshold value, automatically alter one or more characteristics of supplying power to the variable-speed fan motor 13, the variable-speed fan motor 13 causes the variable-speed fan 14 to rotate upon power being supplied to the variable-speed fan motor 13, the condenser 15 comprises condenser coils 16, and the variable-speed fan 14 is positioned and oriented to blow air toward the condenser coils 16 upon the variable-speed fan 14 rotating.

The present invention provides numerous advantages. The present invention provides systems and methods that automatically adjust the supply of power to variable-speed motors for driving variable-speed fans for condensers, thereby compensating for the differing construction of different types of variable-speed motors (and even differing construction of similar types of variable-speed motors) that can yield differing results (e.g., fan speed, smoothness, heating of the motor, etc.) upon being supplied the same sequence of voltage variations, including, in particular, where some motors function less than optimally, e.g., exhibiting unwanted effects, such as reduced work, heat generation that is greater than optimal, and/or damage to the motor. Providing such features is especially advantageous in the context of head pressure control, i.e., motors to run fans in AC compressors, because of the large extent to which temperature can rapidly fluctuate in AC compressors.

Any two or more components or structural parts of the systems described herein can be integrated. Any component or structural part of the systems described herein can be provided in two or more parts. Similarly, any two or more functions can be conducted simultaneously, and/or any function can be conducted in a series of steps.

Furthermore, while certain embodiments of the present invention have been illustrated with reference to specific combinations of elements and attributes, various other combinations may also be provided without departing from the teachings of the present invention. Thus, the present invention should not be construed as being limited to the particular exemplary embodiments described herein and illustrated in the Figures, but may also encompass combinations of elements and attributes of the various illustrated embodiments.

Based on the information provided in the present disclosure, many alterations and modifications may be made by those having ordinary skill in the art, given the benefit of the present disclosure, without departing from the teaching of the present specification, and/or without departing from the spirit and scope of the present invention.

The invention claimed is:

1. A system for controlling supplying power to a variable-speed fan motor, the system comprising:

at least a first sensor, and a controller, the sensor senses at least one characteristic from which voltage can be monitored, the controller is configured to:

detect a magnitude of imbalance between positive voltage and negative voltage during cycles while the variable-speed fan motor is operated, wherein the magnitude of imbalance is calculated by monitoring a waveform of voltage being supplied to the variable-speed fan motor, and is equal to a difference between (1) an area above zero volts in the waveform, and (2) an area below zero volts in the waveform, per unit time, compare the detected magnitude of imbalance to a pre-selected threshold value, and if the detected magnitude of imbalance exceeds the pre-selected threshold value, automatically alter one or more characteristics of supplying power to the variable-speed fan motor.

2. A system for controlling supplying power to a variable-speed fan motor, the system comprising:

at least a first sensor, and a controller, the sensor senses at least one characteristic from which voltage can be monitored, the controller is configured to:

detect a me of imbalance bet positive voltage and negative voltage during cycles while the variable speed fan motor is operated, wherein the magnitude of imbalance is calculated by monitoring a waveform of voltage being supplied to the variable-speed fan motor, and is equal to a difference between (1) an area, per cycle, above zero volts in the waveform, and (2) an area, per cycle, below zero volts in the waveform, compare the detected magnitude of imbalance to a pre-selected threshold value, and if the detected magnitude of imbalance exceeds the pre-selected threshold value, automatically after one or more characteristics of supplying power to the variable-speed fan motor.

3. The system recited in claim 1, wherein:

the system further comprises a variable-speed fan motor, a fan and a condenser, the controller controls power supplied to the variable-speed fan motor, the variable-speed fan motor causes the fan to rotate upon power being supplied to the variable-speed fan motor, the condenser comprises condenser coils, and the fan is positioned and oriented to blow air toward the condenser coils upon the fan rotating.

4. The system recited in claim 1, wherein said detecting a magnitude of imbalance, comparing the detected magnitude of imbalance to a pre-selected threshold value, and automatically altering one or more characteristics of supplying power to the variable-speed fan motor if the detected magnitude of imbalance exceeds the pre-selected threshold value are part of a feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than or equal to the pre-selected threshold value, returning to (A) after a first duration of time, and if the detected magnitude of imbalance is greater than the pre-selected threshold value, altering one or more characteristics of supplying power to the variable-speed fan motor, and then returning to (A) after a second duration of time.

5. The system recited in claim 1, wherein said detecting a magnitude of imbalance, comparing the detected magnitude of imbalance to a pre-selected threshold value, and automatically altering one or more characteristics of supplying power to the variable-speed fan motor if the detected magnitude of imbalance exceeds the pre-selected threshold value are part of a feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than the pre-selected threshold value, returning to (A) after a first duration of time, and if the detected magnitude of imbalance is greater than or equal to the pre-selected threshold value, altering one or more characteristics of supplying power to the variable-speed fan motor, and then returning to (A) after a second duration of time.

6. The system recited in claim 1, wherein:

the controller comprises a processor, and the processor is configured to perform said detecting, said comparing and said automatically altering one or more characteristics of supplying power to the variable-speed fan motor if the detected magnitude of imbalance exceeds the pre-selected threshold value.

7. The system recited in claim 6, wherein:

the processor is also configured to:

record detected magnitude of imbalance values and alterations of one or more characteristics of supplying power; and store prior sequences of detected magnitude of imbalance values and alterations of one or more characteristics of supplying power.

8. The system recited in claim 7, wherein:

the processor is also configured to:

compare a current sequence of detected magnitude of imbalance values and alteration of one or more characteristics of supplying power to prior sequences of detected magnitude of imbalance values and alteration of one or more characteristics of supplying power; and cause the controller to follow a sequence in which the next alteration of one or more characteristics of supplying power corresponds to a stored alteration that achieved a favorable magnitude of imbalance after a sequence of detected magnitude of imbalance values and alteration of one or more characteristics of supplying power that correlates to the current sequence of detected magnitude of imbalance values and alteration of one or more characteristics of supplying power.

9. The system recited in claim 1, wherein said automatically altering one or more characteristics of supplying power to the variable-speed fan motor comprises altering at least one or more characteristics selected from among:

the positive voltage start time of firing pulses;

the negative voltage start time of firing pulses;

the start times of both the positive voltage firing pulses and negative voltage firing pulses;

the positive voltage end time of firing pulses;

the negative voltage end time of firing pulses;

the end times of both the positive voltage firing pulses and negative voltage firing pulses;

the duration of positive voltage firing pulses;

the duration of negative voltage firing pulses; and the durations of both the positive voltage firing pulses and the negative voltage firing pulses.

10. The system recited in claim 1, wherein said automatically altering one or more characteristics of supplying power to the variable-speed fan motor comprises altering a shape of the waveform.

11. The system recited in claim 1, wherein the first sensor is selected from among voltage sensors, current sensors and power sensors.

12. A method for controlling supplying power to a variable-speed fan motor, the method comprising:

detecting a magnitude of imbalance between positive voltage and negative voltage during cycles while the variable-speed fan motor is operated, wherein the magnitude of imbalance is calculated by monitoring a waveform of voltage being supplied to the variable-speed fan motor, and is equal to a difference between (1) an area above zero volts in the waveform, and (2) an area below zero volts in the waveform, per unit time, comparing the detected magnitude of imbalance to a pre-selected threshold value, and if the detected magnitude of imbalance exceeds the pre-selected threshold value, automatically altering one or more characteristics of supplying power to the variable-speed fan motor.

13. The method recited in claim 12, wherein:

the variable-speed fan motor is part of a system that comprises the variable-speed fan motor, a fan and a condenser, the method further comprises controlling power supplied to the variable-speed fan motor, the variable-speed fan motor causes the fan to rotate upon power being supplied to the variable-speed fan motor, the condenser comprises condenser coils, and the fan is positioned and oriented to blow air toward the condenser coils upon the fan rotating.

14. The method recited in claim 12, wherein said detecting a magnitude of imbalance, comparing the detected magnitude of imbalance to a pre-selected threshold value, and, if the detected magnitude of imbalance exceeds the pre-selected threshold value, automatically altering one or more characteristics of supplying power to the variable-speed fan motor, are part of a feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than or equal to the pre-selected threshold value, returning to (A) after a first duration of time, and if the detected magnitude of imbalance is greater than the pre-selected threshold value, altering one or more characteristics of supplying power to the variable-speed fan motor, and then returning to (A) after a second duration of time.

15. The method recited in claim 12, wherein said detecting a magnitude of imbalance, comparing the detected magnitude of imbalance to a pre-selected threshold value, and automatically altering one or more characteristics of supplying power to the variable-speed fan motor if the detected magnitude of imbalance exceeds the pre-selected threshold value are part of a feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than the pre-selected threshold value, returning to (A) after a first duration of time, and if the detected magnitude of imbalance is greater than or equal to the pre-selected threshold value, altering one or more characteristics of supplying power to the variable-speed fan motor, and then returning to (A) after a second duration of time.

16. A method for controlling supplying power to a variable-speed fan motor, the method comprising:

detecting a magnitude of imbalance between positive voltage and negative voltage during cycles while the variable-speed fan motor is operated, wherein the magnitude of imbalance is calculated by monitoring a waveform of voltage being supplied to the variable-speed fan motor, and is equal to a difference between (1) an area, per cycle, above zero volts in the waveform, and (2) an area, per cycle, below zero volts in the waveform comparing the detected magnitude of imbalance to a pre-selected threshold value, and if the detected magnitude of imbalance exceeds the pre-selected threshold value, automatically altering one or more characteristics of supplying power to the variable-speed fan motor.

17. A fan system, comprising:

at least a first sensor;

a controller;

a variable-speed fan motor; and a fan, the sensor senses at least one characteristic from which voltage can be monitored, the controller is configured to:

detect a magnitude of imbalance between positive voltage and negative voltage during cycles while the variable-speed fan motor is operated, wherein the magnitude of imbalance is calculated by monitoring a waveform of voltage being supplied to the variable speed fan motor, and is equal to a difference between (1) an area above zero volts in the waveform, and (2) an area below zero volta in the waveform, per unit time, compare the detected magnitude of imbalance to a pre-selected threshold value, and if the detected magnitude of imbalance exceeds the pre-selected threshold value, automatically alter one or more characteristics of supplying power to the variable-speed fan motor, and the variable-speed motor causes the fan to rotate upon power being supplied to the variable-speed motor.

18. The fan system recited in claim 17, wherein said detecting a magnitude of imbalance, comparing the detected magnitude of imbalance to a pre-selected threshold value, and automatically altering one or more characteristics of supplying power to the variable-speed fan motor if the detected magnitude of imbalance exceeds the pre-selected threshold value are part of a feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than or equal to the pre-selected threshold value, returning to (A) after a first duration of time, and if the detected magnitude of imbalance is greater than the pre-selected threshold value, altering one or more characteristics of supplying power to the variable-speed fan motor, and then returning to (A) after a second duration of time.

19. The fan system recited in claim 17, wherein said detecting a magnitude of imbalance, comparing the detected magnitude of imbalance to a pre-selected threshold value, and automatically altering one or more characteristics of supplying power to the variable-speed fan motor if the detected magnitude of imbalance exceeds the pre-selected threshold value are part of a feedback loop that comprises:

(A) detecting the magnitude of imbalance between positive voltage and negative voltage during cycles during operation of the variable-speed fan motor, then (B) comparing the detected magnitude of imbalance to the pre-selected threshold value, and then (C)

if the detected magnitude of imbalance is less than the pre-selected threshold value, returning to (A) after a first duration of time, and if the detected magnitude of imbalance is greater than or equal to the pre-selected threshold value, altering one or more characteristics of supplying power to the variable-speed fan motor, and then returning to (A) after a second duration of time.

20. The fan system recited in claim 17, wherein:

the controller comprises a processor, and the processor is configured to perform said detecting, said comparing and said automatically altering one or more characteristics of supplying power to the variable-speed fan motor if the detected magnitude of imbalance exceeds the pre-selected threshold value.

21. The fan system recited in claim 20, wherein:

the processor is also configured to:

record detected magnitude of imbalance values and alterations of one or more characteristics of supplying power; and store prior sequences of detected magnitude of imbalance values and alterations of one or more characteristics of supplying power.

22. The fan system recited in claim 21, wherein:

the processor is also configured to:

compare a current sequence of detected magnitude of imbalance values and alteration of one or more characteristics of supplying power to prior sequences of detected magnitude of imbalance values and alteration of one or more characteristics of supplying power; and cause the controller to follow a sequence in which the next alteration of one or more characteristics of supplying power corresponds to a stored alteration that achieved a favorable magnitude of imbalance after a sequence of detected magnitude of imbalance values and alteration of one or more characteristics of supplying power that correlates to the current sequence of detected magnitude of imbalance values and alteration of one or more characteristics of supplying power.

23. The fan system recited in claim 17, wherein said automatically altering one or more characteristics of supplying power to the variable-speed fan motor comprises altering at least one or more characteristics selected from among:

the positive voltage start time of firing pulses;

the negative voltage start time of firing pulses;

the start times of both the positive voltage firing pulses and negative voltage firing pulses;

the positive voltage end time of firing pulses;

the negative voltage end time of firing pulses;

the end times of both the positive voltage firing pulses and negative voltage firing pulses;

the duration of positive voltage firing pulses;

the duration of negative voltage firing pulses; and the durations of both the positive voltage firing pulses and the negative voltage firing pulses.

24. The fan system recited in claim 17, wherein said automatically altering one or more characteristics of supplying power to the variable-speed fan motor comprises altering a shape of the waveform.

25. The fan system recited in claim 17, wherein the first sensor is selected from among voltage sensors, current sensors and power sensors.

26. The fan system recited in claim 17, wherein:

the system further comprises a condenser, the condenser comprises condenser coils, and the fan is positioned and oriented to blow air toward the condenser coils upon the fan rotating.

27. A fan system comprising:

at least a first sensor;

a controller;

a variable-speed fan motor; and a fan, the sensor senses at least one characteristic from which voltage can be monitored, the controller is configured to:

detect a magnitude of imbalance between positive voltage and negative voltage during cycles while the variable-speed fan motor is operated, wherein the magnitude of imbalance is calculated by monitoring voltage being supplied to the variable-speed fan motor, and is equal to a difference between (1) an area, per cycle, above zero volts in the waveform, and (2) an area, per cycle, below zero volts in the waveform, compare the detected magnitude of imbalance to a pre-selected threshold value, and if the detected magnitude of imbalance exceeds pre-selected threshold value, automatically after one or more characteristics of supplying power to the variable-speed fan motor, and the variable-speed motor causes the fan to rotate upon power being supplied to the variable-speed motor.

* * * * *